US009079451B2

(12) United States Patent
Dudret et al.

(10) Patent No.: US 9,079,451 B2
(45) Date of Patent: Jul. 14, 2015

(54) DOCUMENT PROCESSING MACHINE SUCH AS AN ENVELOPE OPENER

(75) Inventors: Julie Dudret, le Perray en Yvelines (FR); Patrick Fournier, Paris (FR); Jean-Christian Maleyran, le Perray en Yvelines (FR); Francois Reby, Nogent sur Marne (FR)

(73) Assignee: SECAP Groupe Pitney Bowes, St. Denis, Cedex (FR)

( * ) Notice: Subject to any disclaimer, the term of this patent is extended or adjusted under 35 U.S.C. 154(b) by 1627 days.

(21) Appl. No.: 12/400,237

(22) Filed: Mar. 9, 2009

(65) Prior Publication Data

US 2010/0059923 A1 Mar. 11, 2010

(30) Foreign Application Priority Data

Mar. 10, 2008 (FR) ..... 08 51529

(51) Int. Cl.

| | |
|---|---|
| ***B26D 7/06*** | (2006.01) |
| ***B26D 7/18*** | (2006.01) |
| ***B43M 7/00*** | (2006.01) |
| ***B26D 1/24*** | (2006.01) |

(52) U.S. Cl.
CPC ..... *B43M 7/005* (2013.01); *B26D 1/245* (2013.01); *B26D 7/18* (2013.01)

(58) Field of Classification Search
CPC ..... B26D 1/245; B26D 7/18; B43M 7/005
USPC ..... 83/23, 27, 102, 105, 912, 167; 53/381.2, 381.3, 381.5
See application file for complete search history.

(56) References Cited

U.S. PATENT DOCUMENTS

| | | | | |
|---|---|---|---|---|
| 3,189,342 | A * | 6/1965 | Bocock | 271/303 |
| 3,240,089 | A * | 3/1966 | Chamberlain et al. | 83/105 |
| 3,828,634 | A * | 8/1974 | Luperti | 83/912 |
| 4,224,850 | A * | 9/1980 | Holmi et al. | 83/105 |
| 4,410,315 | A * | 10/1983 | Frye | 83/102 |
| 5,024,862 | A | 6/1991 | Frank | |
| 5,470,182 | A * | 11/1995 | Krupotich et al. | 409/137 |
| 6,234,053 | B1 * | 5/2001 | Olsen et al. | 83/88 |
| 6,912,827 | B2 | 7/2005 | Forbes | |

FOREIGN PATENT DOCUMENTS

| | | |
|---|---|---|
| DE | 19634628 C1 | 10/1997 |
| GB | 1279073 | 6/1972 |
| WO | 2006121256 A1 | 6/1972 |

* cited by examiner

*Primary Examiner* — Stephen Choi
(74) *Attorney, Agent, or Firm* — Steven J. Shapiro; Charles R. Malandra, Jr.

(57) ABSTRACT

A document processing machine such as an envelope opener for moving a document in a longitudinal direction and a device for cutting off a portion of the document is described. The document processing machine includes, adjacent to the cutting device, a mobile guide path for the cut-off portion of the document that is adapted to support and drive the cut-off portion in an ejection direction.

8 Claims, 5 Drawing Sheets

DOCUMENT PROCESSING MACHINE SUCH AS AN ENVELOPE OPENER

RELATED APPLICATIONS

The present application claims priority of French Patent Application No. 0851529, filed Mar. 10, 2008, that is hereby incorporated by reference in its entirety.

BACKGROUND

The present application describes several illustrative embodiments of a document processing machine including in certain aspects an envelope opener. Certain machines are known for processing documents such as envelopes in which a portion of the documents is cut off. Such machines in which the documents are envelopes are commonly called envelope openers. In these machines, the envelopes are driven one by one, for example by belts, in a movement of longitudinal displacement on the surface of a horizontal table forming a support. A device for cutting off a portion of envelopes, in particular one of their edges, is disposed along the table, on one side, to be in contact portion of each envelope to be cut off.

A cutting device 1 is shown diagrammatically in FIG. 1. It comprises a bottom cutter 2 and a top cutter 3 which both have cutting edges arranged adjacent to each other. Both cutters are mounted to rotate about respective horizontal axes 2*b*, 3*b* perpendicular to the longitudinal direction of movement of the envelopes. An annular groove 4 is provided alongside the bottom cutter to receive the cut-off edges of the envelopes. However, the cut-off edges and chaff from envelopes often get trapped in this groove, which in the end impedes subsequent cutting operations.

Moreover, human intervention is necessary to remove all the paper that has accumulated in the groove. It would consequently be of interest to have available a machine that remedies at least one of the drawbacks referred to above.

SUMMARY

To this end, the present application describes several illustrative embodiments of a document processing machine. In at least one embodiment, the machine includes means for moving a document in a longitudinal direction and a device for cutting off a portion of the document, wherein, the machine includes, adjacent to the cutting device, a mobile guide path for the cut-off portion of the document that is adapted to support and drive said cut-off portion in an ejection direction. Several illustrative embodiments are summarized here without limiting the scope of the application.

The cut-off portion of the document, such as an envelope edge, rests on the mobile path and is transported thereby in the ejection direction toward an area of the machine that is not contiguous to the cutting device. Thus the cut-off portion is automatically ejected from the area in which the cutting took place, thereby preventing jamming problems. No manual intervention is therefore necessary.

The ejection direction can adopt different spatial orientations for evacuating the cut-off portions of documents out of the cutting area. According to one feature the guide path comprises a belt extending longitudinally alongside the cutting device and rotatably mounted about two axes perpendicular to the longitudinal direction XX' and the ejection direction. Thus the cut-off portion is transported by the mobile guide belt toward the downstream end of the machine.

A guide path of this kind is particularly simple to implement and offers a minimum overall size.

According to one feature the machine comprises at least one holding member disposed over the guide path in order to maintain the cut-off portion in the ejection direction defined by said guide path. This member also contributes to guiding the cut-off portion in the ejection direction. It holds the cut-off portion in contact with the mobile path, thus ensuring that said cut-off portion is routed in the appropriate direction.

According to one particular feature, said at least one holding member is elastic, enabling it to adapt to thickness differences between the cut-off portions. Thus it can be an elastic blade that is positioned above the guide path, for example.

According to one feature the guide path is inclined at an angle $\alpha$ relative to a plane containing the longitudinal direction XX' and in which the document is moved. The guide path is slightly lower than the document routing plane P in order to collect the cut-off portion of each document by gravity. The path is therefore oriented in a direction (ejection direction) that is not contained in a plane parallel to the plane P but is contained in a plane intersecting the plane P.

The angle $\alpha$ can be positive or negative depending on the place to which the cut-off portions (chaff) are to be ejected. Thus the angle is close to 180°, for example, if the chaff is required to exit underneath the machine and in the opposite direction to that in which the documents are displaced. The angle is −90°, for example, for vertical upward exit of the chaff (above the document routing support). According to one feature the guide path is inclined downward relative to the horizontal plane P. Thus the cut-off portion is directed downward, which naturally facilitates its evacuation by gravity.

According to one feature the machine includes means for longitudinally guiding the document downstream of the cutting device to prevent pivoting of the document caused by the cutting operation. To be more specific, these guide means take the form of a longitudinal wall situated downstream of the cutting device. This wall can extend in the upstream direction and feature a housing in which the cutting device is arranged so as to be disposed flush with the wall.

According to one feature the machine comprises means for deviating the cut-off and ejected portion of the document that are adapted to deviate said portion in a lateral direction relative to the ejection direction of the guide path. These means placed downstream of the guide path divert the cut-off portion laterally from its trajectory given by the ejection direction. This deviation is beneficial for directing the cutoff portion to the required place (area for collecting cut-off portions and chaff), for example. It will be noted that these means could instead be integrated into the guide path.

According to one particular feature the deviation means comprise a wall placed on the path of the cut-off and ejected portion and that extends in the downstream direction laterally relative to the ejection direction of the guide path. This wall departs from the ejection direction to the side, whilst extending in the downstream direction, i.e. it is skewed relative to the ejection direction. At least the portion of the wall closest to the guide path is curved, for example. For example, the wall has a convexity on the path of the cut-off portion of the document, thereby forcing it to change orientation.

According to one feature a receptacle is provided downstream of the cutting device to receive the document and the cut-off portion of said document. This receptacle is lower than the plane P mentioned hereinabove, for example, so as to receive by gravity, on the one hand, the document and, on the other hand, the cut-off portion.

According to one feature a wall is disposed in the receptacle to separate it into two areas, an area for receiving the document and an area for receiving the cutoff portion of said document. The document receiving area is aligned with the longitudinal direction of movement of the documents.

According to an alternative feature the means for deviating the cut-off portion of the document are adapted to separate the receptacle into two areas, an area for receiving the document and an area for receiving the cutoff portion of said document. Thus the deviation means have a two-fold function: deviating the cut-off portions of the documents in a preferred direction and creating two different receiving areas in the receptacle. To be more specific, these means are adapted to deviate the cut-off portions of the documents into one of the two receiving areas.

According to one feature the deviation means are configured to leave as much room as possible in the receptacle for the document receiving area. Thus these means are adapted to free up the document receiving area so as not to impede their correct reception.

According to one feature the deviation means comprise a separating wall of the receptacle, that wall extending in the downstream direction, inside the receptacle, laterally relative to the longitudinal direction of movement of the document. The separating wall of the receptacle therefore also serves to deviate the cut-off portions of the documents from their initial ejection trajectory. To be more specific, this wall is configured to facilitate reception of the documents in the area concerned and, to this end, it departs laterally from the longitudinal direction of movement of the documents in order to free up the receiving space. If this wall is also the wall that is used to deviate the cut-off portions of the documents, then it can simply be curved: thus one of its faces has a convexity facing toward the cut-off portion receiving area, whereas its opposite face has a concavity oriented toward the document receiving area.

Other features and advantages will become apparent in the course of the following description, given by way of nonlimiting example only and with reference to the appended drawings.

BRIEF DESCRIPTION OF THE DRAWINGS

The accompanying drawings, which are incorporated in and constitute a part of the specification, illustrate embodiments of the application, and together with the description given above and the detailed description of the embodiments given below, serve to explain the principles of the invention. As shown throughout the drawings, like reference numerals designate like or corresponding parts.

DETAILED DESCRIPTION

While the illustrative embodiments of the present application have been disclosed and described with reference to a single illustrative envelope opener device, it will be apparent, as noted above that variations and modifications may be made therein. It is, thus, intended in the following claims to cover each variation and modification that falls within the true spirit and scope of the present invention.

Figure 1:
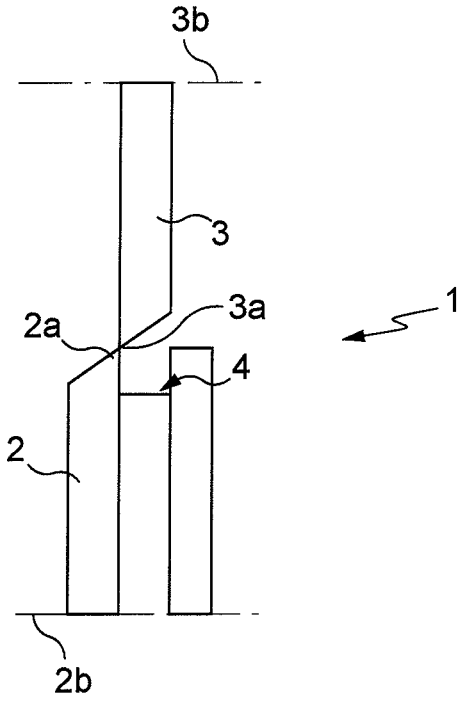
Fig. 1 (PRIOR ART)
FIG. 1 is a view of a prior art document processing machine.
Figure 2:
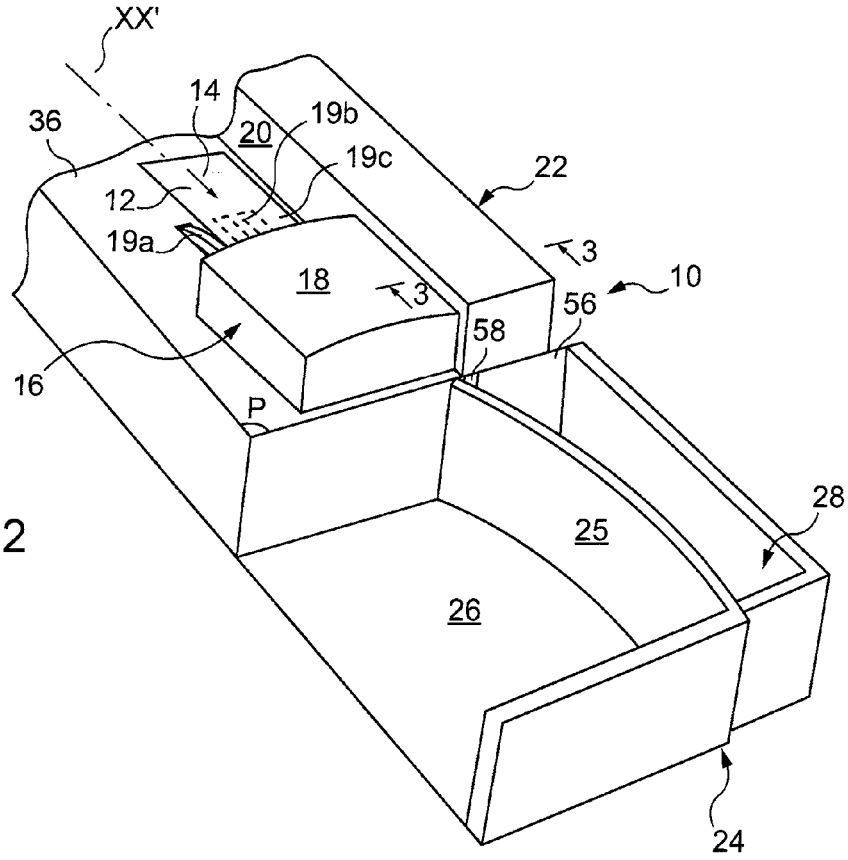
FIG. 2 is a diagrammatic general perspective view of a document processing machine of the invention.

As shown in FIG. 2, a document processing machine 10 according to the illustrative embodiment of the present application processes documents, for example filled envelopes 12. Documents are routed in the machine in the direction indicated by the arrow 14 in FIG. 2 to a document processing module 16 protected by a cover 18. To be more specific, the document 12 is moved in a longitudinal direction XX' by displacement means such as belts 19*a*, 19*b*, 19*c* wrapped around pulleys that are driven in rotation by a motor that is not shown. The document 14 routed along the axis XX' is guided by a longitudinal wall 20 of a module 22 adjacent to the module 16.

The module 22 includes the motor referred to above and various mechanisms, in particular a mechanism for driving the document transport means, as well as the mechanism of the document opening device (cutting device) to be described hereinafter. Farther downstream in the document routing direction, the machine includes a receptacle 24 divided into two compartments or receptacles by a wall 25. One receptacle or compartment 26 has the function of collecting documents and the other receptacle 28 has the function of receiving cut-off portions of documents. Thus there are, downstream of the device for cutting off a portion of the document, an area 26 for receiving the document and an area 28 for receiving the cut-off portion of the document, which in particular is adjacent to the first area.

Figure 3A:
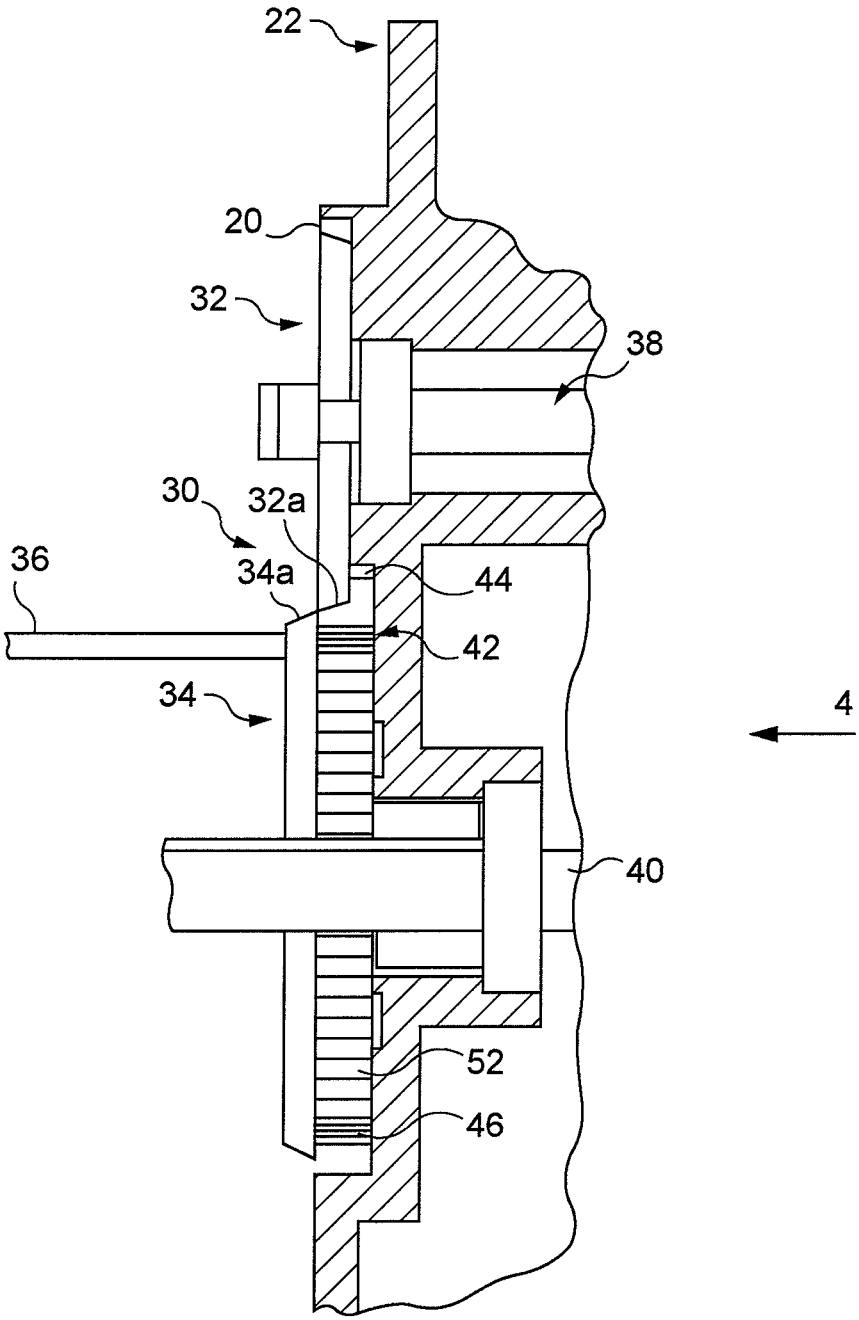
FIG. 3*a* is a diagrammatic view in cross section of a portion of the machine from FIG. 2.

FIG. 3*a* is a partial diagrammatic view in cross section of a cutting device of an illustrative embodiment of the present application and a portion of its mechanism contained in the module 22. The cutting device 30 of the invention includes two cutting members, a top cutting member 32 and a bottom cutting member 34, which are commonly referred to as cutters. These cutters are disposed in an offset fashion in the transverse cutting plane so that their adjacent inclined edges 32*a*, 34*a* can locate appropriately one on each side of the portion of the document to be cut off.

The bottom cutter 34 is arranged against the wall 20 of the module 22, as is the top cutter. The bottom cutter is also disposed against a horizontal plate 36 constituting the document support and forming a plane that contains the longitudinal direction XX' in which the document is moved. It will be noted that the upper edge of the bottom cutter provided with the cutting edge 34*a* is slightly higher than the plate 36.

The top and bottom cutters are mounted to rotate about shafts 38 and 40, respectively, which are driven in rotation by one or more motors, not shown, one of which is the motor described with reference to FIG. 2, for example, used to move the documents (driving the belts 19*a-c*). As represented in FIG. 3*a*, the cutting members of the cutting device 30 therefore cut off a portion of a document such as an envelope 12 introduced between their edges 32*a*, 34*a*.

Figure 3B:
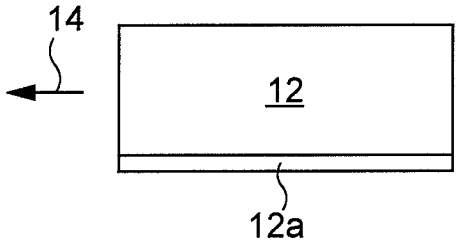
FIG. 3*b* is a plan view showing a document and its cut-off portion.

As represented in FIG. 3*b*, the document (for example the envelope) 12 is opened on one of its longitudinal sides (edges) by a longitudinal cut effected by the cutting device so as to separate the longitudinal cut-off portion 12*a* from the rest of the document. The envelope opened in this way is ejected in the ejection direction 14 and collected in a receptacle with other envelopes previously opened.

Means 42 for guiding and driving the cut-off portion of the document are disposed adjacent to the cutting device and, to be more precise, are in contact with the bottom cutter 34 on the side opposite that on which the document routing support is located. The guiding means 42 are represented in FIG. 4 (as seen in FIG. 3*a* in the direction of the arrow 4) showing the bottom cutting member, the document routing support 36, the displacement belt 19*c*, the envelope 12 resting on that belt and the plane P tangential to the upper surface of the belt and constituting the plane in which the document is moved, together with a member 44 to be described later.

Figure 4:
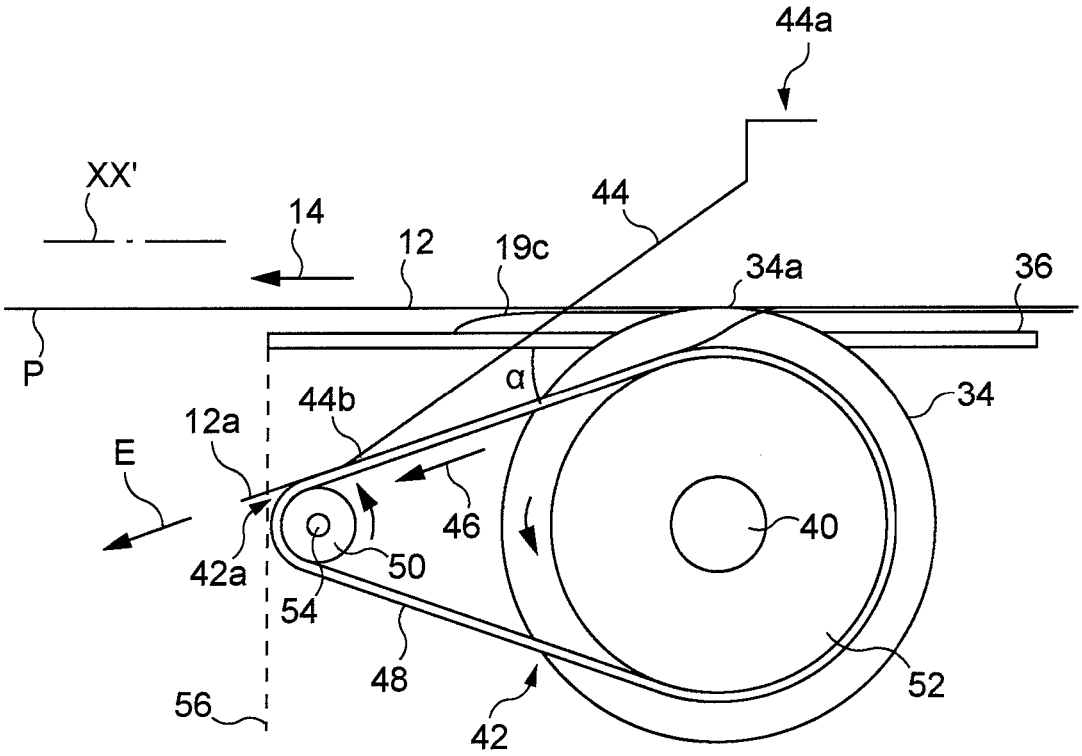
FIG. 4 is a diagrammatic view of a portion of the arrangement shown in FIG. 3*a* as seen in the direction of the arrow 4.

Also shown in FIG. 4 is the cut-off portion 12*a* of the envelope during cutting, i.e. when it is not completely detached from the document. The guide means 42 serve to support the cut-off portion 12*a* and are mobile in order to transport that portion in the direction indicated by the arrow 46. The means 42 thus constitute a mobile guide path for the cut-off portion 12*a* of the document in a direction E referred to hereinafter as the document ejection direction.

The means 42 are slightly lower than the bottom cutting member 34 and, in particular, the means 42 are set back relative to the, cutting edge 34*a* in order to be able to receive by gravity the cut-off portion of the document as shown in FIG. 4. The means 42 comprise, for example, a belt 48 that extends, as seen in a horizontal plane, in the longitudinal direction (along the longitudinal axis XX') alongside the cutting device (FIG. 6) and that is mounted to rotate about two axes perpendicular to the longitudinal direction XX' and to the ejection direction E. These axes are perpendicular to the plane of FIG. 4.

To be more specific, the belt 48 is fitted around two rotary pulleys 50 and 52 mounted to rotate about respective shafts 54 and 40. The guide means 42 are driven by driving the pulley 52 in rotation about the shaft 40, for example, the pulley 50 being an idler pulley, i.e. one that is driven by the movement of the other pulley. Any type of belt is suitable for routing the cutoff portions in the downstream direction. Nevertheless, a notched belt is preferably used to prevent the phenomenon of slipping that can occur with a flat belt.

In order to deviate the cut-off portion of the document as quickly as possible, the guide means 42 have a surface adapted to support the cut-off portion of the document that is inclined at an angle $\alpha$ relative to the plane P in which the document 12 moves or relative to the plate 36. By inclining the guide means downward relative to the plane P and to the plate 36, instead of the cut-off portion of the document remaining in the same plane, the two trajectories (that of the document and that of the cut-off portion) are effectively separated and the cutoff portions of documents recovered by gravity.

The angle $\alpha$ is equal to approximately 20°, for example, which offers sufficient separation of the two trajectories. The guide and drive means referred to above are of particularly simple design and simple to implement since they use drive means of the cutting device and therefore necessitate no specific additional driving mechanism. Moreover, they eject the cut-off portion of the document quickly and effectively and therefore free up the cutting area in which the top and bottom cutters are disposed.

At this location, the ejection speed of the cut-off portion is not sufficient for this cut-off portion to be evacuated effectively. Accordingly, in the absence of the guide means, the cut-off portions of the documents would not be evacuated properly and would accumulate locally.

Figure 5:
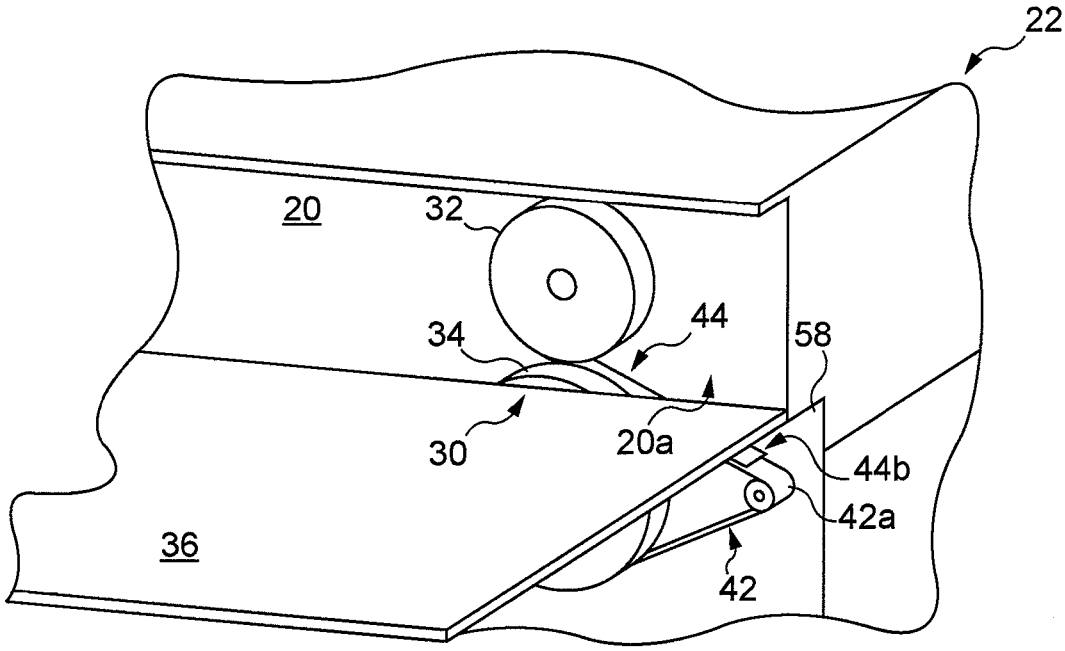
FIG. 5 is a partial perspective view of the FIG. 4 arrangement with the same orientation the as FIG. 1.

FIG. 5 shows in perspective the support 36 and the adjacent wall 20 of the module 22 in which are disposed the top cutter 32 and the guide and drive means 42. The building of these elements into arrangements (housings or recesses) in the wall 20 is shown in more detail and in cross section in FIG. 3*a*. The top cutter 32 is flush with the wall and the means 42 are aligned with the cutter to receive the chaff by gravity. Accordingly, when the portion 12*a* is cut off, the rest of the document 12 is routed in the downstream direction shown by the arrow 14 in FIGS. 3*b*, 4 and 6. The wall 20 is extended downstream of the cutting device 30 in the document routing direction by a wall portion 20*a* that serves as a longitudinal document guide.

In fact, the cutting operation creates on the document a rotation torque which, in the absence of the downstream guide 20*a*, would cause the document to become skewed. This misalignment would impede downstream evacuation of the document and its reception. Thanks to the guide means 20*a*, the document retains its alignment in the direction 14 (FIG. 6) during and after cutting. It will be noted that other means for guiding and driving a cut-off portion of the document can be envisaged without departing from the scope of the invention.

When the document is engaged between the top and bottom cutting members and the latter cut off a portion 12*a* of the document, the latter drops onto the mobile guide path such as just been described and is driven in the ejection direction E shown in FIG. 4. However, to ensure that the cut-off portion of the document will not swing up in the direction of the plate 36, a member 44 (FIG. 4) is arranged above the guide means 42 in order to hold the cut-off portion 12*a* in the ejection direction imposed by the guide path.

This member 44 (the presence of several such members may be envisaged) extends from an end 44*a* located above the plate 36, inclined downwardly in the direction of the guide path. Its free opposite end 44*b* is in contact with the guide path. Thus the cut-off portion 12*a* is fed onto the belt by the rotation of the belt 48 and the pressure exerted by the member 44. The free end 44*b* is located as close as possible to the exit from the guide path, in the vicinity of the place where the cut-off portion of the document is ejected. The pressure exerted by the member 44 thus located on the cut-off portion driven by the guide path 42 offsets its point of ejection in the downstream direction. If the free end 44*b* were farther upstream on the guide path, the ejection speed of the cut-off portion would be at a maximum further upstream and would be lower at the exit from the path. Ejection efficiency would therefore be reduced.

The member 44 is attached to the module 22 by its upper end 44*a*, which is built into the latter in a manner that is not shown. It will be noted that the top cutter 32 prevents lateral displacement of the member 44 (FIG. 3*a*). This member is elastic to maintain a light pressure on the belt. The coefficient of friction being higher between the back of the belt 48 and the chaff 12*a* than between the chaff and the member 44, the chaff is necessarily driven in the downstream direction (as far as the exit point 42*a* to be described in detail later). This member takes the form of a thin elastic blade, for example. The elastic nature of the member absorbs thickness differences between the cut-off portions of documents.

The elastic member 44 is shown in FIG. 3*a* vertically above the guide means 42 and its width is less than that of the latter in order to reduce the overall size. It will be noted that the member 44 can be replaced by a train of rotary rollers driven by the belt 48. Alternatively, the member 44 can be replaced by a second belt driven by contact with the first belt 48.

Figure 6:
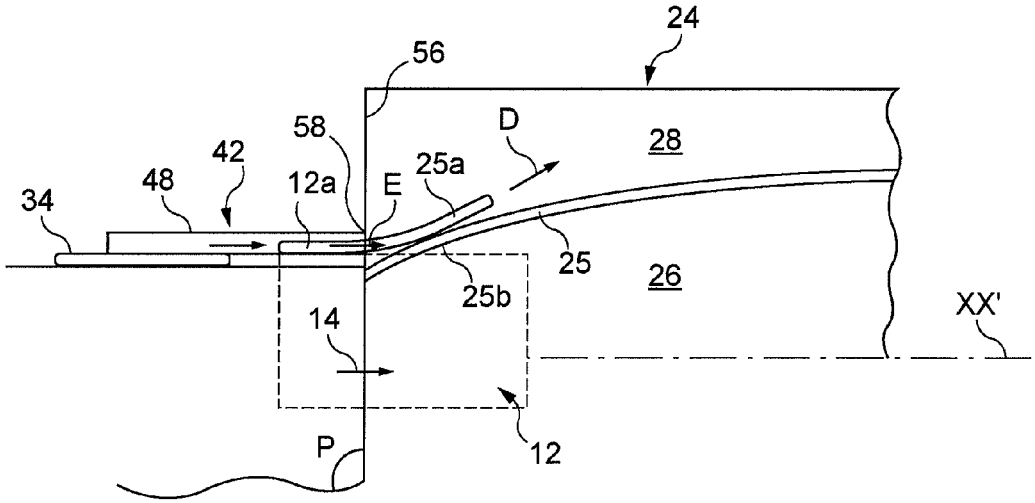
FIG. 6 is a general diagrammatic plan view of a portion of the machine from FIG. 2 showing the routing of a cut-off portion of a document as far as a collecting receptacle.

The cut-off portion 12*a* of the document is ejected in the direction E defined by the guide path 42 that is parallel to the direction 14 in which the documents are routed as seen in a horizontal plane (FIG. 6). However, as seen in FIG. 4, the ejection direction E and the routing direction of the documents 14 form an angle ex between them in the plane of FIG. 4 (vertical plane).

The document processing machine of the invention includes a wall 56 downstream of the guide means 42 (FIG. 2) in which an opening 58 is made in line with the guide means 42, and more particularly the end 42*a* (exit point) of the latter through which the cut-off portion 12*a* is ejected (the wall 56 is shown in dashed line in FIG. 4). The wall 56 is disposed transversely relative to the longitudinal direction XX I (FIG. 6), for example, and separates the portion of the machine forming the receptacle 24 from the remainder of the machine upstream thereof (cutting device, etc.).

As shown in FIG. 6, the cut-off portion 12*a*, also called chaff, is ejected through the opening 58 in the ejection direction E and downstream of that opening encounters means for deviating this cut-off portion in an oblique direction D that has a transverse (or lateral) and longitudinal component. These deviation means comprise the wall 25 referred to above that serves as a wall for separating the receptacle into two receiving areas 26 and 28. This wall 25 extends both in a lateral direction relative to the ejection direction E and in a longitudinal downstream direction.

More specifically, this wall is curved, especially in the portion closest to the guide path and the opening 58 (and especially the wall 56 to which it is connected). The wall 25 serving as means for deviating the cutoff portion 12*a* of the document has a convex portion 25*a* facing the compartment 28 so as forcibly to deviate the cut-off portion 12*a* of the document when it encounters this area of the wall. The cut-off portion 12*a* is therefore re-oriented in the direction D and drops to the bottom of the receiving area 28, where the cut-off portions of previous documents have accumulated.

The wall 25 has on its opposite face a concave area 25*b* oriented toward the document receiving area 26. The fact that the wall 25 extends downstream from the wall 56 and diverges radially from the longitudinal axis XX' (direction 14) in which the documents are ejected into the receiving area 26 enlarges the receiving area and therefore leaves more space free to receive documents. The concave surface 25*b* of the wall frees up the space inside the area 26. However, it should be noted that for the function of deviating cut-off document portions it is not necessary for the deviation means (provided here by the wall 25, for example) also to free up the receiving area 26.

It should be noted that the separating wall 25 between the two receiving areas could also be curved in the direction of the receiving area 26 so as to present to documents ejected in the direction 14 a convex surface deviating the documents laterally relative to that direction. This feature could be combined with the means for deviating the cut-off portion of the document, thereby enabling the cut-off portion of the document, and the document itself to be deviated laterally in opposite directions at the same time.

An equally feasible alternative is to consider that only the documents are deviated, for example by reversing the curvature of the wall 25, the cut-off document portions then being directed into the receptacle 28 in the ejection direction E.

It will be noted, however, that because of a larger storage volume necessary for the documents than for the cut-off portions, it is preferable to deviate the latter rather than only the documents themselves.

A fortiori, depending on the configurations of the machine and congestion around it, it can be judicious to arrange the receptacles differently and thus to provide an orientation suitable for ejecting the cut-off portions of the documents and the documents themselves.

In this regard, the cut-off portions and/or the documents can be deviated into separate receiving areas situated at the same height, as in FIG. 2, or at different heights.

Providing only one receptacle for receiving the documents or the cut-off portions can equally be envisaged, a removable bin being used to collect the remainder. A user can then read the content of the envelopes opened in this way later.

What is claimed is:

1. A document processing machine comprising:

means for moving a document in a longitudinal direction, and a device for cutting off a portion of the document, wherein, the document processing machine includes, adjacent to the cutting device, a mobile guide path for the cut-off portion of the document that is adapted to support and transport said cut-off portion in an ejection direction, further comprising, at least one holding member disposed over the guide path in order to bias the cut-off portion against the moving mobile guide path and to maintain the cut-off portion in the ejection direction defined by said guide path and means for longitudinally guiding the document downstream of the cutting device.

2. The machine according to claim 1, wherein the guide means consists of a longitudinal wall placed in the original initial ejection path of the cut-off portion.

3. A document processing machine comprising machine comprising:

means for moving a document in a longitudinal direction, and a device for cutting off a portion of the document, wherein, the document processing machine includes, adjacent to the cutting device, a mobile guide path for the cut-off portion of the document that is adapted to support and transport said cut-off portion in an ejection direction, further comprising:

at least one holding member disposed over the guide path in order to bias the cut-off portion against the moving mobile guide pat and to maintain the cut-off portion in the ejection direction defined by said guide path means for deviating the cut-off and ejected portion of the document that are adapted to deviate said portion in a lateral direction relative to the ejection direction of the guide path and wherein, the guide path is inclined at an angle between 20 and 90 degrees relative to a plane containing the longitudinal direction an in which the document is moved.

4. The machine according to claim 3, wherein, the deviation means comprise a wall placed on the path of the cut-off and ejected portion and that extends in the downstream direction laterally relative to the ejection direction of the guide path.

5. The machine according to claim 4 wherein, the wall is curved at least in its portion closest to the guide path.

6. A document processing machine comprising:

means for moving a document in a longitudinal direction, and a device for cutting off a portion of the document, wherein, the document processing machine includes, adjacent to the cutting device, a mobile guide path for the cut-off portion of the document that is adapted to support and transport said cut-off portion in an ejection direction, further comprising:

at least one holding member disposed over the guide path in order to bias the cut-off portion against the moving mobile guide path and to maintain the cut-off portion in the ejection direction defined by said guide path and further including a receptacle provided downstream of the cutting device to receive the document and the cut-off portion of said document; and means for deviating the cutoff portion of the document, wherein said means for deviating the cut-off portion of the document are adapted to separate the receptacle, into two areas, a first area for receiving the document and a second area for receiving the cutoff portion of said document.

7. The machine according to claim 6, wherein, the deviation means are configured to leave as much room as possible in the receptacle for the document receiving area.

8. The machine according to claim 6, wherein, the deviation means comprise a curved separating wail of the receptacle, that wall extending in the downstream direction, inside the receptacle, laterally relative to the longitudinal direction of movement of the document.

* * * * *